US007144525B2

(12) United States Patent
Yoshikawa et al.

(10) Patent No.: US 7,144,525 B2
(45) Date of Patent: Dec. 5, 2006

(54) ELASTIC MEMBER OF SEMICONDUCTIVE POLYMER AND OA EQUIPMENT USING THE SAME

(75) Inventors: Hitoshi Yoshikawa, Komaki (JP); Akitoshi Nozawa, Komaki (JP); Satoshi Suzuki, Kasugai (JP); Kunio Ito, Kasugai (JP)

(73) Assignee: Tokai Rubber Industries, Ltd., Komaki (JP)

( * ) Notice: Subject to any disclaimer, the term of this patent is extended or adjusted under 35 U.S.C. 154(b) by 441 days.

(21) Appl. No.: 10/229,280

(22) Filed: Aug. 28, 2002

(65) Prior Publication Data

US 2003/0157369 A1 Aug. 21, 2003

(30) Foreign Application Priority Data

Aug. 28, 2001 (JP) ..... 2001-258039
Aug. 23, 2002 (JP) ..... 2002-243904
Aug. 26, 2002 (JP) ..... 2002-244886

(51) Int. Cl.
*G03C 1/89* (2006.01)
*G03G 15/02* (2006.01)
*H01B 1/12* (2006.01)

(52) U.S. Cl. ..... 252/500; 430/529; 430/902; 430/527; 430/531; 430/62; 399/115; 399/176; 361/225; 361/222; 492/53; 492/59; 428/694 B

(58) Field of Classification Search ..... 252/500, 252/511, 519.3; 399/115, 176; 528/423; 361/225, 222; 492/53, 59; 430/902, 62, 430/529, 527, 531, 41; 428/694 B, 694 R
See application file for complete search history.

(56) References Cited

U.S. PATENT DOCUMENTS 5,382,486 A * 1/1995 Yu et al. ..... 430/56
5,434,653 A 7/1995 Takizawa et al. ..... 355/259
5,602,712 A * 2/1997 Daifuku et al. ..... 361/225
5,674,654 A * 10/1997 Zumbulyadis et al. ..... 430/41
5,795,953 A * 8/1998 Kim et al. ..... 526/258
6,432,324 B1 * 8/2002 Yoshida et al. ..... 252/500
2002/0193547 A1 * 12/2002 Yuasa et al. ..... 526/312

FOREIGN PATENT DOCUMENTS

| | | | |
|---|---|---|---|
| JP | 7-33977 | | 2/1995 |
| JP | 10-39582 | | 2/1998 |
| JP | 10-169641 | | 6/1998 |
| JP | 11-174822 | | 7/1999 |
| JP | 2001-009958 | * | 1/2001 |

* cited by examiner

*Primary Examiner*—Mark Kopec
*Assistant Examiner*—Kallambella Vijayakumar
(74) *Attorney, Agent, or Firm*—Armstrong, Kratz, Quintos, Hanson & Brooks, LLP

(57) ABSTRACT

An elastic member of a semiconductive polymer comprising a conductive composition containing a conductive polymer and binder polymer, wherein the elastic member satisfies both characteristics of (A) a variation of 1.5 digit or less between the electrical resistance at an applied voltage of 1V and the electrical resistance at an applied voltage of 133V under an environment of 25° C. and 50% RH, and (B) a variation of one digit or less between the electrical resistance at an applied voltage of 10V under an environment of 15° C. and 10% RH and the electrical resistance at an applied voltage of 10V under an environment of 35° C. and 85% RH.

7 Claims, 1 Drawing Sheet

ELASTIC MEMBER OF SEMICONDUCTIVE POLYMER AND OA EQUIPMENT USING THE SAME

BACKGROUND OF THE INVENTION

The present invention relates to an elastic member of a semiconductive polymer and OA equipment using the elastic member. In particular, the present invention relates to an elastic member of a semiconductive polymer to be used at least a part of constituting members of OA (Office Automation) equipment such as a developing roll, a charging roll, a transfer roll, a toner supply roll, a discharging roll, a sheet feed roll, a cleaning roll, a developing blade, a charging blade, a cleaning blade and a transfer belt, and an OA equipment using the elastic member.

DESCRIPTION OF THE ART

It is usually inevitable for the elastic member of a semiconductive polymer to be used for OA equipment such as the developing roll to control electrical resistance for proper use thereof. For this purpose, electrical resistance has been controlled by blending an ion-conductive agent or electron-conductive agent material into a binder polymer such as a resin or rubber.

The ion-conductive agent possesses some advantages such that conductivity of the polymer rather becomes uniform since it is dissolved in the binder polymer, variation of the electrical resistance against voltage fluctuation is small, and it is excellent in voltage dependency of the electrical resistance. However, the mechanism of the ion-conductive agent for manifesting a conductive property depends on ions carrying electric charge. Consequently, while control of the conductive property is possible at an electrical resistance of $1\times10^7$ Ω·cm or more due to good ionic conductance in the binder polymer, control of the conductive property becomes difficult at an electrical resistance of less than $1\times10^7$ Ω·cm since ionic conductance hardly takes place. In addition, since the ion-conductive agent is susceptible to moisture, the electrical resistance shows two digit or more of variation under high temperature—high humidity and low temperature—low humidity conditions. Therefore, the ion-conductive agent is poor in the environment dependency of the electric resistance to render many limitations for use in OA equipment.

The electron-conductive agents such as carbon black are hardly affected by moisture, and have small variation of electric resistance under high temperate—high humidity and low temperature—low humidity conditions. Since the electron-conductive agents are excellent in environment dependency of the electrical resistance while being able to make the binder polymer to have low electrical resistance, they are suitable for use in OA equipment. However, since it is difficult for the electron-conductive agent to be uniformly dispersed in the binder polymer, the electrical resistance of the polymer is distributed in a wide range to make it difficult to control the conductive property. When the conductive agent is relatively uniformly distributed, on the other band, variation of the electrical resistance against voltage fluctuation becomes large since the mechanism for manifesting the conductive property depends on a tunnel effect or hopping effect by which electrons are transferred between carbon particles in the binder polymer under a high voltage, thereby making the binder polymer to have poor voltage dependency of the electrical resistance.

SUMMARY OF THE INVENTION

Accordingly, it is an object of the present invention carried out considering the situations as hitherto described to provide an elastic member of a semiconductive polymer having excellent characteristics in both the voltage dependency and environment dependency of the electric resistance, and an OA equipment using the elastc member.

The present invention for solving the foregoing objects provides an elastic member of a semiconductive polymer comprising a conductive composition containing a conductive polymer and a binder polymer. The elastomer satisfies both characteristics of (A) a variation of 1.5 digits or less between the electrical resistance at an applied voltage of 1V and the electrical resistance at an applied voltage of 133V under an environment of 25° C. and 50% RH, and (B) a variation of one digit or less between the electrical resistance at an applied voltage of 10V under an environment of 15° C. and 10% RH and the electrical resistance at an applied voltage of 10V under an environment of 35° C. and 85% RH. The present invention also provides an OA equipment using the elastic member of a semiconductive polymer for at least a part of the constituting member of the OA equipment.

The inventors of the present invention have found, through intensive studies for obtaining an elastic member of a semiconductive polymer being excellent in both voltage dependency and environment dependency of the electrical resistance, that the objects can be attained by using an elastic member of a semiconductive polymer satisfying both characteristics of (A) a variation of 1.5 digits or leas between the electrical resistance at an applied voltage of 1V and the electrical resistance at an applied voltage of 133V under an environment of 25° C. and 50% RH, and (B) a variation of one digit or less between the electrical resistance at an applied voltage of 10V under an environment of 15° C. and 10% RH and the electrical resistance at an applied voltage of 10V under an environment of 35° C. and 85% RH, thereby completing the present invention.

The semiconductive property of the elastic member of a semiconductive polymer according to the present invention means that the electrical resistance as measured in accordance with the method described in SRIS 2304 is in the range of $1\times10^{12}$ Ω·cm or less.

DESCRIPTION OF THE PREFERRED EMBODIMENTS

Figure 1:
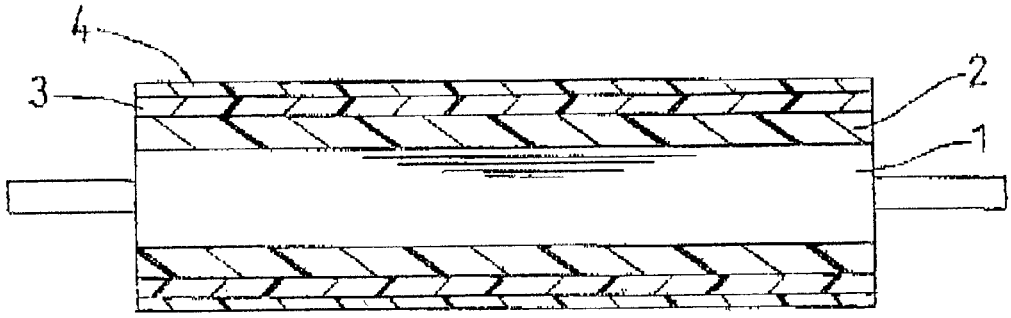
FIG. 1 shows a cross section of a conductive roll using the elastic member of the semiconductive polymer according to the present invention.

The embodiments of the present invention will be described hereinafter.

The elastic member of a semiconductive polymer according to the present invention can be obtained using a conductive composition comprising a conductive polymer and a binder polymer.

While the conductive polymer is not particularly restricted, a conductive polymer containing a surfactant structure may be favorably used.

The conductive polymer having a surfactant structure may be manufactured, for example, by a chemical oxidative polymerization of a starting monomer of the conductive polymer with an oxidizer in the presence of a surfactant.

The starting monomers of the conductive polymer are not particularly restricted so long as they are conductive, and examples thereof include aniline (including aniline derivatives and aniline salts such as aniline hydrochloride), pyrrole, thiophene, alkyl thiophene, ethylene dioxythiophene, isonaphthothiophene, 3-thiophene-β-ethane sulfonic acid, dithienothiophene, acetylene, paraphenylene, phenine vinylene, furan, selenophene, tellurophene, isothianaphthene, paraphenylene sulfide, paraphenylene oxide and vinylene sulfide.

While the surfactants are not particularly restricted, and examples of them include anionic surfactants such as a long-chain alkylsulfate and cationic surfactants such as a long-chain alkylammonium salt as well as neutral surfactants. They may be used alone, or in combination of at least two of them.

Examples of the long chain alkylsulfates of the anionic surfactant include dodecyl sulfonic acid, dodecylbenzene sulfonic acid, pentadecyl sulfonic acid and naphthalene sulfonic acid.

Examples of the long chain-alkylammonium salts of the cationic surfactants include acetyltrimethyl ammonium bromide.

Examples of the oxidizers include ammonium persulfate, aqueous hydrogen peroxide and iron (III) chloride.

The mixing ratio of the starting monomer of the conductive polymer to the surfactant is preferably in the range of 1/0.03 to 1/3, and in particular 1/0.05 to 1/2 in molar ratio. The mixing ratio is selected in the range as described above because the monomer has less compatibility with and dispersing ability to the binder polymer when the molar ratio of the surfactant is decreased, while the proportion of the electronic conductance of the conductive polymer decreases due to a too strong ionic conductance effect of the surfactant when the molar ratio of the surfactant is increased.

The number average molecular weight (Mn) of the conductive polymer is preferably in the range of 500 to 100,000, and particularly in the range of 1,000 to 20,000.

The binder polymer to be used in combination with the conductive polymer is not particularly restricted, and examples thereof include acrylic, urethane, fluoride, polyamide, epoxy and rubber elastomers and resins. They may be used alone, or in combination of at least two of them. The acrylic and rubber elastomers or resins are preferable among them in their excellent compatibility with the conductive polymers Examples of the acrylic elastomers or resins include polymethyl methacrylate (PMMA), polyethyl methacrylate, polymethyl acrylate, polyethyl acrylate, polyhydroxyl methacrylate, acrylic silicone resin, acrylic fluorinated resin and copolymers of acrylic monomers known in the art.

Examples of the urethane elastomers or resins include ether based, ester based, acrylic and aliphatic urethanes, or copolymers thereof with silicone based polyols or fluorinated polyols. The urethane elastomers or resins may have a urea bond or an imide bond.

Examples of the fluorinated elastomers or resins include polyvinylidene fluoride (PVDF), fluorinated vinylidene-tetrafluoroethylene copolymer and fluorinated vinylidene-tetrafluoroethylene-hexafluoropropylene copolymer.

Examples of the polyamide based elastomers or resins include an alcohol soluble methoxymethylated nylon.

Examples of the epoxy elastomers or resins include bisphenol A and epoxy-novolac resins as well as bromine type and polyglycol type elastomers or resins, resins and elastomers to be used together with a polyamide resin, an amino resin or an alkyd resin, and elastomers and resins modified with silicone.

Examples of the rubber elastomer or resin include thermoplastic polymer known in the art such as a natural rubber (NR), butadiene rubber (BR), acrylonitrile-butadiene rubber (NBR), hydrogenated NBR (H-NBR), styrene-butadiene rubber (SBR), isoprene rubber (IR), urethane rubber, chloroprene rubber (CR), epichlorohydrin rubber (ECO), ethylene-propylene-diene polymer (EPDM), fluorinated rubber, styrene-butadiene block copolymer (SBS) and styrene-ethylene-butylene-styrene block copolymer (SEBS).

The binder polymer has a number average molecular weight (Mn) preferably in the range of 500 to 2,000,000, in particular in the range of 2,000 to 800,000.

The mixing ratio of the starting material of the conductive polymer (a combined amount of the starting monomer of the conductive polymer and surfactant) to the binder polymer is preferably in the range of 1/99 to 40/60, particularly in the range of 4/96 to 35/65 in weight ratio. The effect an the conductive property becomes small when the weight ratio of the starting material of the conductive polymer is less than 1. When the weight ratio of the starting material of the conductive polymer exceeds 40, on the other hand, the conductive composition tends to be rigid and fragile to deteriorate physical properties as a composition.

An ion-conductive agent, an electron-conductive agent and a cross-linking agent may be blended to the conductive composition in addition to the conductive polymer and binder polymer.

Examples of the ion-conductive agent include lithium perchlorate, quaternary ammonium salts, boric acid salts and surfactants. They may be used alone, or in combination of at least two of them.

The blending ratio of the ion-conductive agent is preferably in the range of 0.01 to 5 parts by weight, in particular 0.5 to 2 parts by weight, relative to 100 parts by weight of a combined amount of the starting material of the conductive polymer having a surfactant structure (a combined amount of the starting polymer and surfactant) and binder polymer in view of the physical properties and electrical characteristics ("parts by weight" is abbreviated as "parts" hereinafter).

Examples of the electron-conductive agent include carbon black, c-ZnO (conductive zinc oxide), c-$TiO_2$ (conductive titanium oxide), c-$SnO_2$ (conductive tin oxide) and graphite.

The blending ratio of the electron-conductive agent is preferably in the range of 5 to 30 parts, in particular 8 to 20 parts, relative to 100 parts of a combined amount of the starting material of the conductive polymer (a combined amount of the starting polymer and surfactant) and binder polymer in view of the physical properties and electrical characteristics.

Examples of the cross-linking agent include sulfur, isocyanate, blocked isocyanate, urea resins such as melamine, epoxy hardening agents, polyamine hardening agents and peroxides.

The blending ratio of the cross-linking agent is preferably in the range of 1 to 30 parts, in particular 3 to 10 parts, relative to 100 parts of a combined amount of the starting material of the conductive polymer (a combined amount of the starting polymer and surfactant) and the binder polymer in view of the physical properties, tackiness and storage stability of the solution.

A cross-linking accelerator, a catalyst, an anti-aging agent and a dopant may be blended to the conductive composition, if necessary, in addition to each component as described above.

Examples of the cross-linking accelerator include a sulfenamide based cross-linking accelerator, a dithiocarbamic acid based cross-linking accelerator, amines and an organic tin based accelerator.

The conductive composition can be produced as follows. The conductive polymer is produced by the method as described above. Then, the binder polymer as well as the ion-conductive agent, electron-conductive agent and cross-linking agent, it necessary, are blended to the conductive polymer. The conductive composition can be obtained by kneading the mixture using a kneading machine such as a roll, a kneader or a Banbury mixer. The conductive polymer is preferably soluble in a solvent or forms a colloidal solution, and the binder polymer is preferably soluble in a solvent.

The conductive polymer produced by the method as described above may be dispersed in the binder polymer using a high shear stress dispersion mill. The particle diameter of the conductive polymer is made finer using the high shear stress dispersion mill, which is preferable for compatibility or uniform and minute dispersion of the conductive polymer in the binder polymer. The particle diameter (median diameter) of the conductive polymer is preferably 1 μm or less. It is desirable not to completely dry the conductive polymer for preventing the conductive polymer from being aggregated in the purification step of the conductive polymer in producing the conductive composition.

Examples of the high shear stress dispersion mill include a high speed beads mill taking advantage of glass beads or ceramic beads such as zirconia, a sand mill, a ball mill, a triaxial roll, a compression Kneader and a colloid mill taking advantage of a grinding force.

Examples of the solvent include m-cresol, methanol, methylethyl ketone (MEK) and toluene.

In a most prominent aspect, the present invention provides an elastic member of a semiconductive polymer satisfying following both characteristics of (A) a variation of 1.5 digits or less between the electrical resistance at an applied voltage of 1V and the electrical resistance at an applied voltage of 133V under an environment of 25° C. and 50% RH (voltage dependency: the difference between the maximum value and the minimum value of the electrical resistance), and (B) a variation of one digit or less between the electrical resistance at an applied voltage of 10V under an environment of 15° C. and 10% RH and the electrical resistance at an applied voltage of 1V under an environment of 35° C. and 85% RH (environment dependency).

The voltage dependency oaf the electrical resistance is assessed by measuring the electrical resistance by applying a voltage of 1V and the electrical resistance by applying a voltage of 133V, respectively, under an environment of 25° C. and 50% RH, followed by indicating the difference of the logarithm of the electrical resistance as digits of variation from the equation of Log(resistance at 1V/resistance at 133V).

Variation of the electrical resistance under an environment (environment dependency) is assessed by measuring the electrical resistance under a low temperature and low humidity environment (15° C. and 10% RH) and the electrical resistance under a high temperature—high humidity environment (35° C. and 85% RH), respectively, by applying a voltage of 10V, followed by indicating the difference of the electrical resistance as digits of variation from the difference of logarithm of the electrical resistance calculated by Log(resistance at 15° C. and 10% RH/resistance at 35° C. and 85% RH.

The elastic member of the semiconductive polymer comprising the conductive composition preferably has a electrical resistance in the range of $10^8$ to $10^{12}$ Ω·cm at an applied voltage of 10V under an environment of 25° C. and 50% RH. A leak current is generated due to too low electrical resistance when the electrical resistance is less than $10^6$ Ω·cm, making the semiconductive elastic member less advantageous for OA equipment. When the electrical resistance exceeds $10^{12}$ Ω·cm, on the contrary, the semiconductive elastic member is charged up due to its too high electrical resistance, making the elastic member to be hardly controllable for OA equipment.

The elastic member of the semiconductive polymer comprising the conductive composition preferably shows 1.3 digit or less of increment of the electrical resistance at 100% elongation as compared with the electrical resistance with no elongation of the elastic member. When the increment of the electrical resistance exceeds 1.3 digits, the electrical resistance may be changed by using the elastic member under a deformation with a soft member, thereby making the elastic member to be hardly controllable when used for OA equipment with an adverse effect on the image quality such as an uneven image density. For measuring the variation of the electrical resistance before and after 100% elongation, the elastic member of the semiconductive polymer comprising the conductive composition is punched into a strip test specimen (an width of 10 mm and a length of 100 mm), electrodes are coated on reference lines, the electrical resistance is measured before elongation and after 100% elongation at an applied voltage of 10V under an environment of 25° C. and 50% RH, and the variation of digits of the electrical resistance before and after elongation is measured from Log(electrical resistance after elongation/electrical resistance before elongation), An example of the OA equipment using the elastic member of the semiconductive polymer according to the present invention is a conductive roll shown in FIG. 1, wherein a base layer 2 is formed on the outer circumference face of a shaft 1, an intermediate layer 3 is formed on the outer circumference face of the base layer, and a surface layer 4 comprising the elastic member of the semiconductive polymer according to the present invention is formed on the outer circumference face of the intermediate layer.

The shaft 1 is not particularly restricted, and includes a rod with a metallic solid core or a hollow metallic cylinder. The metallic materials include stainless steel, aluminum and plated iron. An adhesive or a primer may be coated on the shaft 1, if necessary. The adhesive or primer may be optionally made to be conductive.

While the material for the base layer 2 is not particularly restricted, and includes silicone rubber, polyurethane based elastomer, EPDM, SBR and NBR. Silicone rubber is preferable among them due to its low rigidity and less fatigue. The silicone rubber surface may be activated by corona discharge or plasma discharge followed by coating with a primer when the silicone rubber is used for the material of the base layer 2.

A conductive agent may be appropriately added to the material for the base layer 2. Examples of the conductive agent include carbon black, graphites potassium titanate, iron oxide, c-$TiO_2$, c-ZnO, c-$SnO_2$ and ion-conductive agents (quaternary ammonium salts, boric acid salts and surfactants).

The material for the intermediate layer 3 is not particularly restricted, and includes NBR, hydrogenated acrylonitrile-butadiene rubber (H-NBR), polyurethane based elastomer, CR, natural rubber, BR and IIR. H-NBR is particularly preferable among them in view of tackiness and stability of the coating solution.

A conductive agent, vulcanizing agent such as sulfur, vulcanization accelerating agent such as guanidine, thiazole, sulfenamide, dithiocarbamic acid salts and thiuram, stearic acid, zinc white (ZnO) and softening agent may be optionally added to the material for the intermediate layer 3. The conductive agents as hitherto described may be used in this case.

The conductive roll shown in FIG. 1 can be manufactured, for example, as follows. At first, respective components for the material of the base layer 2 are kneaded using a kneading machine such as a kneader to prepare the material for the base layer 2. Respective components for the material of the intermediate layer 3 are also kneaded using a kneading machine such as a roll, and the material for the intermediate layer 3 (a coating solution) is prepared by adding the organic solvent with stirring. The conductive composition as the material of the surface layer 4 is prepared by the method as described previously.

Figure 2:
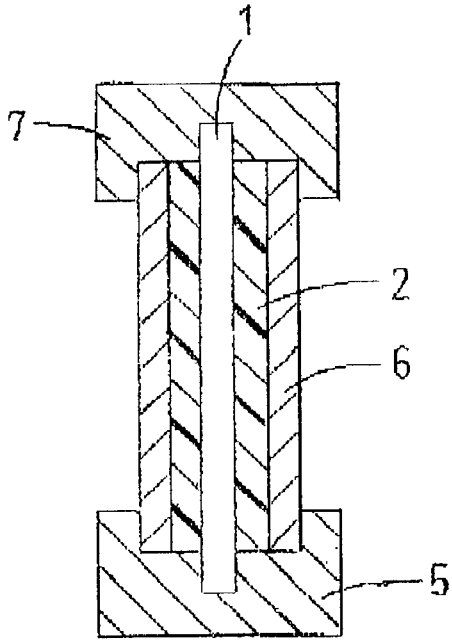
FIG. 2 is a cross section snowing the method for preparing the conductive roll.

Subsequently, the shaft 1 is prepared by coating an adhesive and primer, if necessary, on the outer circumference face thereof, and the shaft 1 is fitted in the cylindrical mold 6 externally fixed with a bottom cover 5 as shown in FIG. 2. Then, the material for the base layer 2 is molded by injection, followed by externally fitting a top cover 7 on the cylindrical mold 6. Subsequently, the material for the base layer 2 is vulcanized by heating the entire roll mold (150 to 220° C. for 30 minutes) to form the base layer 2. Then, the shaft 1 on which the base layer 2 is formed is released from the mold, and the reaction is allowed to complete at a desired time (80 to 200° C. for 4 hours), followed by a corona discharge treatment on the surface of the roll, if necessary. The coupling agent is also coated on the surface of the roll when required. Then, a coating solution to serve as the material of the intermediate layer 3 is coated on the outer circumference of the base layer 2. Alternatively, the roll after forming the base layer 2 is dipped into the coating solution and is pulled up followed by drying and heat treatment, thereby forming the intermediate layer 3 on the outer circumference of the base layer 2. Subsequently, a composition (a coating solution) to serve as the material of the surface layer 4 is coated on the outer circumference of the intermediate layer 3, or the roll after forming the intermediate layer 3 is dipped in the composition (the coating solution) and pulled up, followed by drying and heat treatment to form the surface layer 4 on the outer circumference of the intermediate layer 3. The method for coating the coating solution is not particularly restricted, and the methods include a dipping method, spray coating method and roll coat method known in the art. The base layer 2 is formed along the outer circumference face of the shaft 1, the intermediate layer 3 is formed on the outer circumference of the base layer, and the surface layer 4 is formed on the outer circumference of the intermediate layer by the procedure described above, thereby manufacturing the conductive roll.

Use of the elastic member of the semiconductive polymer according to the present invention is not limited to the member for the surface layer 4 of the conductive roll shown in FIG. 1, and it may be used for the members for the base layer 2 and intermediate layer 3. Use of the elastic member of the semiconductive polymer according to the present invention is also not restricted to the roll members such as the conductive roll, and it may be used for OA equipment including belt members such as a transfer belt and sheet feed belt, and blade members such as cleaning blade, developing blade and charging blade. Furthermore, the elastic member of the semiconductive polymer may be used for a sensor of OA equipment taking advantage of electrical characteristics and electronic members such as anti-static agents and actuators.

Examples and Comparative Examples will be described hereinafter.

Prior to presenting the Examples and Comparative Examples, the following compositions were prepared. Conductive coating films or foamed sheets (referred to as conductive coating films hereinafter) were formed using these compositions for evaluations hereinafter.

Composition 1

After oxidative polymerization of 1 mole of aniline and 1 mole of a surfactant (dodecylbenzene sulfonate) in water in the presence of 1 mole of an oxidizer (ammonium persulfate), unreacted residues were removed with methanol to obtain polyaniline having a surfactant structure. Then, 20 parts of an effective ingredient (the nonvolatile fraction) of polyaniline having the surfactant structure was blended with 80 parts of polymethyl methacrylate (PMMA made by Sumitomo Chemical Co., number average molecular weight 20,000) to obtain a composition by kneading at 80° C. for 10 minutes using a kneader. The composition was molded by extrusion to prepare a conductive coating film with a thickness of 100 μm.

Composition 2

After oxidative polymerization of 1 mole of aniline and 1 mole of a surfactant (dodecylbenzene sulfonate) in water in the presence of 1 mole of an oxidizer (ammonium persulfate), unreacted residues were removed with methanol and added with m-cresol to obtain solution of polyaniline having a surfactant structure. Subsequently, after dissolving 80 parts of polymethyl methacrylate (PMMA made by Sumitomo Chemical Co., number average molecular weight 20,000) as a binder polymer in 500 parts of a solvent (m-cresol), 20 parts of the effective ingredient (nonvolatile traction) of polyaniline solution was added to the solution, and the mixture was kneaded using a triaxial roll to prepare a composition (a coating solution). The composition (the coating solution) was coated on a SUS 304 plate, and a conductive coating film with a thickness of 100 μm was prepared.

Composition 3

After oxidative polymerization of 1 mole of aniline and 0.05 mole of a surfactant (dodecylbenzene sulfonate) in water in the presence of 1 mole of an oxidizer (ammonium persulfate), unreacted residues were removed with methanol and added with m-cresol to obtain solution of polyaniline having a surfactant structure. Subsequently, after dissolving 89.5 parts of polymethyl methacrylate (PMMA made by Sumitomo Chemical Co., number average molecular weight 20,000) as a binder polymer in 500 parts of a solvent (m-cresol), 10.5 parts of an effective ingredient (nonvolatile fraction) of polyaniline solution was added to the solution, and the mixture was kneaded using a triaxial roll to prepare a composition (a coating solution). The composition (the coating solution) was coated on a SUS 304 plate, and a conductive coating film with a thickness of 100 μm was prepared.

Composition 4

After oxidative polymerization of 1 mole of aniline and 2 mole of a surfactant (dodecylbenzene sulfonate) in water in the presence of 1 mole of an oxidizer (ammonium persulfate), unreacted residues were removed with methanol and added with m-cresol to obtain solution of polyaniline having a surfactant structure. Subsequently, after dissolving 66.7 parts of polymethyl methacrylate (PMMA made by Sumitomo Chemical Co., number average molecular weight 20,000) as a binder polymer in 500 parts of a solvent (m-cresol), 33.3 parts of an effective ingredient (nonvolatile fraction) of polyaniline solution was added to the solution, and the mixture was kneaded using a triaxial roll. The composition (the coating solution) was coated on a SUS 304 plate, and a conductive coating film with a thickness of 100 μm was prepared.

Composition 5

After oxidative polymerization of 1 mole of aniline and 1 mole of a surfactant (dodecylbenzene sulfonate) in water in the presence of 1 mole of an oxidizer (ammonium persulfate), unreacted residues were removed with methanol and added with m-cresol to obtain solution of polyaniline having a surfactant structure. Subsequently, after dissolving 96 parts of polymethyl methacrylate (PMMA made by Sumitomo Chemical Co., number average molecular weight 20,000) as a binder polymer, 4 parts of an effective ingredient (nonvolatile fraction) of the polyaniline solution was added to the solution. The mixture was kneaded using a triaxial roll. The composition (coating solution) was coated on a SUS 304 plate, and a conductive coating film with a thickness of 100 μm was prepared.

Composition 6

After oxidative polymerization of 1 mole of aniline and 1 mole of a surfactant (dodecylbenzene sulfonate) in water in the presence of 1 mole of an oxidizer (ammonium persulfate), unreacted residues were removed with methanol and added with m-cresol to obtain solution of polyaniline having a surfactant structure. Subsequently, after dissolving 65 parts of polymethyl methacrylate (PMMA made by Sumitomo Chemical Co., number average molecular weight 20,000) as a binder polymer in 500 parts of a solvent (m-cresol), 35 parts of an effective ingredient (nonvolatile fraction) of polyaniline solution was added in the solution. The mixture was kneaded using a triaxial roll to prepare a composition (a coating solution). The composition (the coating solution) was coated on a SUS 304 plate, and a conductive coating film with a thickness of 100 μm was prepared.

Composition 7

A conductive coating film was prepared by the same method as used for preparing the composition 2, except that soluble nylon (EF30T made by Teikoku Chemicals Co.) was used in place of polymethyl methacrylate, and 400 parts of methanol and 100 parts of water were used in place of 500 pars of m-cresol.

Composition 8

Polyurethane (carbonate based TPU E980 made by Nihon Miractran Co.) was used in place of polymethyl methacrylate, and 200 parts of methylethyl ketone (MEK) and 300 parts of tetrahydrofuran (THF) were used in pace of 500 parts of m-cresol. A conductive coating film was prepared by the same method as used for preparing the composition 2, except that the solution was allowed to disperse using a high shear stress dispersion mill (Dynomill at 3200 rpm, beads diameter 0.8 mm).

Composition 9

A conductive coating film was prepared by the same method as used for preparing the composition 8, except that the high shear stress dispersion mill was not used.

Composition 10

A conductive coating film was prepared by the same method as used for preparing the composition 2, except that an acrylic fluorinated resin (Difenser TR230K made by Dai Nihon Ink Chemical Co.) was used in place of polymethyl methacrylate, and 200 parts Of methylethyl ketone (MEK) and 300 parts of toluene were used in place of 500 parts of cresol.

Composition 11

After oxidative polymerization of 1 mole of aniline and 1 mole of a surfactant (pentadecylbenzene sulfonate) in water in the presence of 1 mole of an oxidizer (ammonium persulfate), unreacted residues were removed with methanol and added with toluene to obtain solution of polyaniline having a surfactant structure. Subsequently, 80 parts of H-NBR (Zetpol 0020 made by Nihon Zeon Co.) as a binder polymer, 1 part of sulfur as a vulcanization agent, 0.5 parts of sulfenamide based cross-linking accelerator (Nocceler CZ made by Ohuchi Shinko Chemical Industries, Co.) and 0.5 parts of dithiocarbamic acid based cross-linking accelerator (Nocceler BZ made by Ohuchi Shinko Chemical Industries, Co.) were kneaded using a dual-axis roll. After dissolving the mixture in 200 parts of methylethyl ketone (MEK) and 300 parts of toluene, 20 parts of an effective ingredient (nonvolatile fraction) of polyaniline solution was added to the solution to prepare a composition (a coating solution). After coating the composition (the coating solution) on a SUS 304 plater the coating film was cross-linked by heating at 150° C. for 30 minutes, thereby preparing a conductive coating film with a thickness of 100 μm.

Composition 12

A conductive coating film was prepared by the same method as used for preparing the composition 11, except that 5 parts of acetylene black (Denka Black HS100 made by DENKA Co.) was further blended.

Composition 13

A conductive coating film was prepared by the same method for preparing the composition 11, except that 1 part of a quaternary ammonium salt (tetrabutylammonium hydrogensulfate: TBAHS) and 1 part of a boric acid salt (LR147 made by Nihon Carlit Co,) were further blended.

Composition 14

After oxidative polymerization of 1 mole of pyrrole and 1 mole of a surfactant (pentadecylbenzene sulfonate) in water in the presence of 0.1 mole of an oxidizer (iron (III) chloride), unreacted residues were removed with methanol and added with toluene to obtain solution of polypyrrole having a surfactant structure. Subsequently, after dissolving 80 parts of polyurethane (carbonate based TPU E980 made by Nihon Miractran Co.) as a binder polymer in 200 parts of methylethyl ketone (MEK) and 300 parts of tetrahydrofuran (THF), 20 parts of an effective ingredient (nonvolatile fraction) of polypyrrole solution was added to prepare a composition (a coating solution). A conductive coating film with a thickness of 100 μm was prepared by coating the composition (the coating solution) on a SUS 304 plate and heating at 150° C. for 30 minutes.

Composition 15

After oxidative polymerization of 1 mole of 3,4-ethylene dioxythiophene and 1 mole of a surfactant (pentadecylbenzene sulfonate) in water in the presence of 0.2 mole of au oxidizer (ammonium persulfate), unreacted residues were removed with methanol and added with toluene to obtain solution of polythiophene having a surfactant structure. Subsequently, after dissolving 80 parts of polyurethane (carbonate based TPU E980 made by Nihon Miractran Co.) as a binder polymer in 200 parts of methylethyl ketone (MEK) and 300 parts of tetrahydrofuran (THF), 20 parts of the effective ingredient (nonvolatile fraction) of polythiophene solution was added to prepare a composition (a coating solution) A conductive coating film with a thickness of 100 μm was prepared by coating the composition (the coating solution) on a SUS 304 plate, and heating at 150° C. for 30 minutes.

Composition 16

After oxidative polymerization of 1 mole of aniline and 0.3 mole of a surfactant (pentadecylbenzene sulfonate) in water in the presence of 1 mole of an oxidizer (ammonium persulfate), unreacted residues were removed with methanol and added with toluene to obtain solution of polyaniline having a surfactant structure. Subsequently, after dissolving 80 parts of polyurethane (carbonate based TPU E980 made by Nihon Miractran Co.) as a binder polymer in 200 parts of methylethyl ketone (MEK) and 300 parts of tetrahydrofuran (THF), 20 parts of the effective ingredient (nonvolatile fraction) of polyaniline solution was added to prepare a composition (a coating solution). A conductive coating film with a thickness of 100 μm was prepared by coating the composition (the coating solution) on a SUS 304 plate, and heating at 150° C. for 30 minutes.

Composition 17

Kneaded using a triple-axis roll were 90 parts of polyether polyol (FA718 made by Sanyo Chemical Co.), 10 parts of polymer polyol (POP 31-28 made by Mitsui Chemical Co.), 0.5 parts of a tertiary amine catalyst (Kaorizer No. 31 made by Kao Co.), 0.05 parts of a tertiary amine catalyst (Toyocat HX-35 made by Tosoh Co.), 2 parts of an foaming agent (an aqueous solution), 2 parts of a silicone based foam controlling agent (L-5309 made by Nihon Unicar Co,) and 20 parts of polyaniline (without drying) having a surfactant structure prepared by the same method as used for preparing the composition 1. Crude MD1 (8.8 parts, Sumidur 44V20 made by Sumitomo Bayer Urethane Co.) and toluene diisocyanate (20.5 parts, TDI-80 made by Mitsui Chemical Co.) were added to the above mixture with mixing with an injection molding machine to produce a five fold foaming sheet (300 mm×300 mm with a thickness of 10 mm) by heat treating at 80° C. for 30 minutes after injecting into the mold.

Composition A

Blended were 100 parts of epichlorohydrin rubber (Epichromer CG made by Daiso Co.), 2 parts of quaternary ammonium salt (TBAHS made by Lion Co.) as a conductive agent, 10 parts of an acid acceptor (zinc oxide) and 3 parts of a thiourea based cross-linking accelerator (Sanceler 22C made by Sanshin Chemical Co.). The mixture after kneading with a triple-axis roll was dissolved in 300 parts of methylethyl ketone (MEK) and 150 parts of toluene to prepare a composition (a coating solution). A conductive coating film with a thickness of 100 μm was prepared by coating the composition (the coating solution) on a SUS 304 plate and cross-linking by heating at 150° C. for 30 minutes.

Composition B

After dissolving 100 parts of polyurethane (carbonate based TPU E980 made by Nihon Miractran Co.) in 200 parts of methylethyl ketone (MEK) and 300 parts of tetrahydrofuran (THF), 7 parts of acetylene black (Denka Black HS100 made by DENKA Co.) as a conductive agent, and the mixture was kneaded with a triple-axis roll to prepare a composition. A conductive coating film with a thickness of 100 μm was prepared by cross linking by heating at 150° C. for 30 minutes.

Composition C

A conductive coating film was prepared by the same method as used for preparing the composition B, except that the blending amount of acetylene black (Denka Black HS100 made by DENKA Co.) was changed to 20 parts.

Composition D

A conductive coating film with a thickness of 100 μm was prepared by coating silicone rubber (KE1350AB made by Shin-Etsu Chemical Co.) in which carbon is dispersed on a SUS 304 plate.

Composition E

Polyaniline with a surfactant structure was obtained by oxidative polymerization of 1 mole of aniline and 1 mole of a surfactant (pentadecylbenzene sulfonic acid) in the presence of 1 mole of an oxidizer (ammonium persulfate), followed by removal of unreacted residues with methanol, 3 times of filtration and complete elimination of moisture at 100° C. for 30 minutes. Subsequently, 80 parts of H-NBR (Zetpol 0020 made by Nihon Zeon Co.) as a binder polymer, 1 part of sulfur as a cross linking agent, 0.5 parts of sulfenamide based cross linking accelerator (Nocceler CZ made by Ohuchi Sinko Chemical Industries Co.) and 0.5 parts of dithiocarbamate based cross linking accelerator (Nocceler BZ made by Ohuchi Chemical Industries Co.) were kneaded using a dual-axis roll. After dissolving the mixture in 200 parts of methylethyl ketone (MEK) and 300 parts of toluene, parts of toluene, polyaniline having the surfactant structure was added, and the solution was kneaded with a triple-axis roll to prepare a composition (a coating solution). A conductive coating film with a thickness of 100 μm was prepared by cross linking by heating at 150° C. for 30 minutes after coating the composition (the coating solution) on a SUS 304 plate.

Composition F

Blended were 90 parts of polyether polyol (FA718 made by Sanyo Chemical Co.), 10 parts of polymer polyol (POP31-28 made by Mitsui Chemical Co.), 0.5 parts of a tertiary amine catalyst (Kaolizer No 31 made by Kao Co.), 0.05 parts of a tertiary amine catalyst (Toyocat HX-35 made by Tosoh Co.), 2 parts of a foaming agent (aqueous solution), 2 parts of silicone based foam controlling agent (L-5309 made by Nihon Unicar Co.) and 3 parts of Ketjen black, and the mixture was kneaded with a triple-axis roll. Into the kneaded mixture, 8.8 parts of crude MDI (Sumidur 44V20 made by Sumitomo Bayer Urethane Co.) and 20.5 parts of tolylene diisocyanate (TDI-80 made by Mitsui Chemical Co.) were added followed by mixing with an injection molding machine to produce a five fold foaming sheet (300 mm×300 mm with a thickness of 10 mm) by heat treating at 80° C. for 30 minutes after injecting into the mold heated at 80° C.

The electrical resistance was measured using each conductive coating film obtained as described above. Also, voltage dependency and environment dependency of the electrical resistance were evaluated. The results are shown in Tables 1 to 4 below.

Electrical Resistance

Each electrical resistance of the conductive coating film at an applied voltage of 1V or 133V was measured in accordance with SRIS 2304 under an environment of 25° C. and 50% RH.

Voltage Dependency

The electrical resistance at the applied voltage of 1V, and the electrical resistance at the applied voltage of 133V were measured in accordance with the assessment of the electrical resistance described above under the environment of 25° C. and 50% RH, and the difference of the electrical resistance was indicated by variation of digits obtained from Log (resistance at 1V/resistance at 133V).

Environment Dependency

The electrical resistance under a low temperature—low humidity (15° C. and 10% RH) environment, and the electrical resistance under a high temperature—high humidity (35° C. and 85% RH) environment were measured in accordance with the assessment of the electrical resistance described above, and the difference of the electrical resistance was indicated by variation of digits. A voltage of 10V was applied in the measurements.

Particle Diameter

The particle diameter (median diameter) of the conductive polymer dispersed in the binder polymer was measured using a particle size distribution analyzer LA920 made by Horiba Co. The particle diameter (median diameter) of the conductive agent was measured with respect to the sample in which no conductive polymer is blended. The sample that was impossible to accurately measure the particle diameter of the conductive polymer due to filler(s) blended in addition to carbon was indicated by a mark "-".

Variation of Electrical Resistance Before Elongation and After 100% Elongation

A conductive coating film comprising each composition as hitherto described was punched into a strip test specimen (10 mm width and 100 mm length), and electrodes were coated on reference lines. Each electrical resistance before elongation and after 100% elongation was measured under an environment of 25° C. and 50% RH to determine the variation (digits) of the electrical resistance before elongation and after elongation. A voltage of 10V was applied for the measurement.

TABLE 1

| | | 1 | 2 | 3 | 4 | 5 | 6 |
|---|---|---|---|---|---|---|---|
| ELECTRICAL RESISTANCE | 1 V | $1.3 \times 10^7$ | $4.2 \times 10^7$ | $1.6 \times 10^6$ | $9.3 \times 10^8$ | $8.3 \times 10^{11}$ | $2.2 \times 10^5$ |
| (Ω · cm) | 133 V | $6.5 \times 10^6$ | $2.1 \times 10^7$ | $9.0 \times 10^5$ | $4.7 \times 10^8$ | $6.6 \times 10^{11}$ | $1.2 \times 10^5$ |
| VOLTAGE DEPENDENCY (DIGIT) | | 0.3 | 0.3 | 0.25 | 0.3 | 0.1 | 0.25 |
| ENVIRONMENT DEPENDENCY (DIGIT) | | 0.3 | 0.3 | 0.3 | 0.3 | 0.9 | 0.3 |
| PARTICLE DIAMETER (MEDIAN DIAMETER | | 0.2 | 0.35 | 0.97 | 0.35 | 0.15 | 0.44 |
| μm) | | *1 | *1 | *1 | *1 | *1 | *1 |
| VARIATION OF ELECTRICAL RESISTANCE | | — | — | — | — | — | — |
| BEFORE ELONGATION AND AFTER 100% | | *2 | *2 | *2 | *2 | *2 | *2 |
| ELONGATION (DIGIT) | | | | | | | |

*1: While the data show the particle size distribution peak as measured by a particle size distribution analyzer, many measuring points exist in the particle size range of 0.1 μm or less, suggesting that a part of the particles dissolve therein or form a colloidal solution.

*2: Measurement is impossible due to the binder is composed of PMMA that is not expandable.

TABLE 2

| | | 7 | 8 | 9 | 10 | 11 | 12 |
|---|---|---|---|---|---|---|---|
| ELECTRICAL RESISTANCE | 1 V | $2.8 \times 10^6$ | $5.6 \times 10^6$ | $3.6 \times 10^7$ | $8.8 \times 10^5$ | $9.2 \times 10^7$ | $3.0 \times 10^6$ |
| (Ω · cm) | 133 V | $1.6 \times 10^6$ | $3.5 \times 10^6$ | $8.6 \times 10^6$ | $4.9 \times 10^5$ | $5.2 \times 10^3$ | $2.1 \times 10^5$ |
| VOLTAGE DEPENDENCY (DIGIT) | | 0.25 | 0.2 | 0.62 | 0.25 | 0.25 | 1.15 |
| ENVIRONMENT DEPENDENCY (DIGIT) | | 0.3 | 0.3 | 0.3 | 0.3 | 0.3 | 0.2 |
| PARTICLE DIAMETER (MEDIAN DIAMETER | | 0.97 | 0.51 | 0.88 | 0.76 | 0.26 | 1.5, 0.65 |
| μm) | | *1 | *1 | *1 | *1 | *1 | *2 |
| VARIATION OF ELECTRICAL RESISTANCE BEFORE ELONGATION AND AFTER 100% ELONGATION (DIGIT) | | 1.1 | 0.7 | 0.9 | 1.2 | 0.7 | 1.3 |

*1: While the data show the particle size distribution peak as measured by a particle size distribution analyzer, many measuring points exist in the particle size range of 0.1 μm or less, suggesting that a part of the particles dissolve therein or form a colloidal solution.

*2: Two peaks at a diameter of 1.5 μm that seems to correspond to the dispersion peak of carbon black, and at a diameter of 0.65 μm that seems to correspond to the dispersion peak of polyaniline were observed. Many measuring points also exist in the particle size range of 0.1 μm or less, suggesting that a part of polyaniline dissolves therein or forms a colloidal solution.

TABLE 3

| | | 13 | 14 | 15 | 16 | 11 |
|---|---|---|---|---|---|---|
| ELECTRICAL RESISTANCE | 1 V | $2.1 \times 10^8$ | $4.5 \times 10^6$ | $6.3 \times 10^6$ | $2.4 \times 10^7$ | $7.8 \times 10^7$ |
| (Ω · cm) | 133 V | $1.2 \times 10^8$ | $1.3 \times 10^6$ | $1.3 \times 10^6$ | $1.1 \times 10^6$ | $4.8 \times 10^3$ |
| VOLTAGE DEPENDENCY (DIGIT) | | 0.25 | 0.54 | 0.68 | 1.34 | 0.21 |
| ENVIRONMENT DEPENDENCY (DIGIT) | | 0.4 | 0.2 | 0.2 | 0.2 | 0.4 |
| PARTICLE DIAMETER (MEDIAN DIAMETER | | 0.25 | 0.96 | 0.95 | 0.98 | 0.77 |
| μm) | | *1 | *1 | *1 | *1 | *1 |
| VARIATION OF ELECTRICAL RESISTANCE BEFORE ELONGATION AND AFTER 100% ELONGATION (DIGIT) | | 0.6 | 0.9 | 1.1 | 1.3 | 0.5 |

*1: While the data show the particle size distribution peak as measured by a particle size distribution analyzer, many measuring points exist in the particle size range of 0.1 μm or less, suggesting that a part of the particles dissolve therein or form a colloidal solution.

TABLE 4

| | | A | B | C | D | E | F |
|---|---|---|---|---|---|---|---|
| ELECTRICAL RESISTANCE | 1 V | $3.5 \times 10^7$ | $3 \times 10^{10}$ | $7 \times 10^5$ | $4.5 \times 10^4$ | $4.2 \times 10^{10}$ | $3 \times 10^{10}$ |
| (Ω · cm) | 133 V | $2.3 \times 10^7$ | $1.8 \times 10^9$ | $2.2 \times 10^3$ | $1.8 \times 10^3$ | $5.9 \times 10^6$ | $5 \times 10^7$ |
| VOLTAGE DEPENDENCE (DIGIT) | | 0.19 | 2.2 | 2.5 | 1.07 | 1.85 | 2.78 |
| ENVIRONMENT DEPENDENCY (DIGIT) | | 2.3 | 0.3 | 0.03 | 0.03 | 0.3 | 0.4 |
| PARTICLE DIAMETER (MEDIAN | | — | 4.5 | 6.7 | — | 13.8 | 3.2 |
| DIAMETER μm) | | | * | * | | * | * |
| VARIATION OF ELECTRICAL RESISTANCE BEFORE ELONGATION AND AFTER 100% ELONGATION (DIGIT) | | 0.3 | 3.6 | 2.9 | 4.2 | 1.6 | 2.6 |

*: Results of measurement as normal distribution

The results in the tables show that, while the compositions B, C, D and F in which the electron-conductive agent is blended have a remarkably large variation of the electrical resistance before elongation and after 100% of elongation, the compositions 7 to 17 containing the conductive polymer (the conductive polymer having a surfactant structure) have a very small variation of the electrical resistance before elongation and after 100% of elongation. This is probably because, although the electron-conductive agent that serves as a conduction passageway is independently dispersed in the compositions B, C, D and F, the conductive polymer that serves as the conduction passageway is uniformly dispersed in the binder polymer with electrical coupling with each other in the compositions 7 to 17. Although variation of the electrical resistance cannot be measured in the compositions 1 to 6 since PMMA used as the binder polymer was impossible to elongate, the experimental results show that voltage dependency and environment dependency of the electrical resistance are small. These results suggest that the conductive polymers in the compositions 1 to 6 are also distributed in the binder polymer in the same manner as in the compositions 7 to 17.

Preparation of Developing Roll

EXAMPLE 1

Silicone rubber (KE1350AB made by Shin-Etsu Chemical Co.) containing dispersed carbon alas injected into an injection molding die in which a core metal (SUS304 with a diameter of 10 mm) as a shaft had been fitted, and the molded silicone rubber was released after heating at 150° C. for 45 minutes to form a base layer along the outer circumference face of the shaft. The surface of the base layer was treated by corona discharge (0.3 kW, 20 seconds). Then, an intermediate layer was formed by coating the composition C prepared above on the outer circumference face of the base layer. In addition, a surface layer comprising the composition 1 prepared above was formed on the surface of the intermediate layer, thereby preparing a developing roll comprising the base layer on the outer circumference of the shaft, the intermediate layer on the outer circumference face of the base layer, and the surface layer on the outer circumference face of the intermediate layer.

EXAMPLES 2 TO 18, AND COMPARATIVE EXAMPLES 1 TO 5

Developing rolls were prepared by the same method as in Example 1, except that the compositions shown in Tables 5 to 8 were used as the materials for the intermediate layer and surface layer. However, the intermediate layer or surface layer was formed after a corona discharge treatment (0.3 kW for 20 seconds) of the base layer in Comparative Examples 1 to 5. The samples having no base layer or intermediate layer were denoted by "None" in corresponding cells of the table.

Characteristics of the roll were assessed in accordance with the following criteria using the rolls obtained in Examples and Comparative Examples. The results are shown in Tables 5 to 8.

Electrical Resistance

A load of 1 kg was applied at both ends of the developing roll while pressing the surface of the developing roll on a SUS plater and the electrical resistance between the core metal of the developing roll and the surface of the developing roll pressed onto the SUS plate was measured in accordance with SRIS 2304. The electrical resistance was measured at each applied voltage of 1V and 133V under an environment of 25° C. and 50% RH.

Voltage Dependency

The electrical resistance at the applied voltage of 1V and the electrical resistance at the applied voltage of 133V were measured under the environment of 25° C. and 50% RH in accordance with the assessment method of the electrical resistance described above, and the difference of the electrical resistance between the two measurements was indicated by digits of variation from Log (resistance at 1V/resistance at 133V).

Environment Dependency

The electrical resistance under a low temperature—low humidity environment (15° C. and 10% RH), and the electrical resistance under a high temperature—high humidity (35° C. and 85% RH ) environment were measured in accordance with the assessment method of the electrical resistance described above, and the difference of the electrical resistance between the two measurements was indicated by digits of variation. A voltage of 10V was applied in this measurement.

Hardness

Hardness (type A) was measured in accordance with Japanese Industrial Standard K 6253 (hereinafter Japanese Industrial Standard abbreviated as "JIS").

Compression Set

The compression set was measured in accordance with JIS K 6262 at a temperature of 70° C. and test time of 22 hours with a compression ratio of 25%.

Characteristics of Developing Roll (Uneven Image)

The developing roll obtained was assembled into a commercially available color printer, and images were printed under ad environment of 20° C. and 50% RH. An image having no irregular density ascribed to the roll at half-tone printing as well as no broken lines and irregular color tones was assessed to be "good", and an image manifesting irregular density was assessed to be "poor".

(Environmental Variation)

The developing roll obtained was assembled into a commercially available color printer, and images were printed under the environments of 15° C. and 10% RH, and 35° C. and 85% RH. The printed images obtained under both environments were assessed as environmental variations of the image. Solid images were measured with a Macbeth densitometer, and the image with a variation of optical density of 0.1 or less was assessed to be "good", while the image with a variation of the optical density of exceeding 0.1 was assessed as "poor".

TABLE 5

| | | EXAMPLE | | | | | |
|---|---|---|---|---|---|---|---|
| | | 1 | 2 | 3 | 4 | 5 | 6 |
| SURFACE LAYER | COMPOSITION No. | 1 | 2 | 3 | 4 | 5 | 6 |
| | THICKNESS (μm) | 7 | 6 | 7 | 7 | 7 | 7 |
| INTERMEDIATE LAYER | COMPOSITION No. | C | C | C | C | C | C |
| | THICKNESS (μm) | 50 | 50 | 50 | 50 | 50 | 50 |
| THICKNESS OF BASE LAYER (mm) | | 4 | 4 | 4 | 4 | 4 | 4 |
| ELECTRICAL RESISTANCE | 1 V | $6.1 \times 10^4$ | $9.3 \times 10^4$ | $4.5 \times 10^4$ | $1.2 \times 10^5$ | $1.2 \times 10^9$ | $4.3 \times 10^4$ |
| (Ω) | 133 V | $1.2 \times 10^4$ | $2.8 \times 10^4$ | $4.3 \times 10^3$ | $6.1 \times 10^5$ | $9 \times 10^0$ | $3.2 \times 10^3$ |
| VOLTAGE DEPENDENCY (DIGIT) | | 0.7 | 0.52 | 1.02 | 0.26 | 0.1 | 1.1 |
| ENVIRONMENT DEPENDENCY | | 0.3 | 0.3 | 0.3 | 0.3 | 0.1 | 0.2 |
| HARDNESS (JIS A) | | 31 | 31 | 32 | 33 | 32 | 32 |
| COMPRESSION PERMANENT DISTORTION (%) | | 7 | 7 | 8 | 8 | 8 | 8 |
| CHARACTERISTICS OF DEVELOPING ROLL | UNEVEN IMAGE | GOOD | GOOD | GOOD | GOOD | GOOD | GOOD |
| | ENVIRONMENTAL CHANGE | GOOD | GOOD | GOOD | GOOD | GOOD | GOOD |

TABLE 6

| | | EXAMPLE | | | | | |
|---|---|---|---|---|---|---|---|
| | | 7 | 8 | 9 | 10 | 11 | 12 |
| SURFACE LAYER | COMPOSITION No. | 7 | 8 | 9 | 10 | 11 | 12 |
| | THICKNESS (μm) | 10 | 50 | 50 | 10 | 50 | 50 |
| INTERMEDIATE LAYER | COMPOSITION No. | NONE | NONE | NONE | NONE | NONE | NONE |
| | THICKNESS (μm) | | | | | | |
| THICKNESS OF BASE LAYER (mm) | | 4 | 4 | 4 | 4 | 4 | 4 |
| ELECTRICAL RESISTANCE | 1 V | $4.2 \times 10^4$ | $9.2 \times 10^4$ | $4 \times 10^5$ | $5.4 \times 10^4$ | $9.6 \times 10^5$ | $6.6 \times 10^4$ |
| (Ω) | 133 V | $6.2 \times 10^3$ | $3.8 \times 10^4$ | $8.9 \times 10^4$ | $4.2 \times 10^3$ | $5.2 \times 10^5$ | $5.1 \times 10^3$ |
| VOLTAGE DEPENDENCY (DIGIT) | | 0.82 | 0.38 | 0.65 | 1.1 | 0.26 | 1.1 |
| ENVIRONMENT DEPENDENCY | | 0.2 | 0.1 | 0.1 | 0.1 | 0.2 | 0 |
| HARDNESS (JIS A) | | 28 | 24 | 24 | 25 | 23 | 23 |
| COMPRESSION PERMANENT DISTORTION (%) | | 8 | 6 | 6 | 6 | 5 | 6 |
| CHARACTERISTICS OF DEVELOPING ROLL | UNEVEN IMAGE | GOOD | GOOD | GOOD | GOOD | GOOD | GOOD |
| | ENVIRONMENTAL CHANGE | GOOD | GOOD | GOOD | GOOD | GOOD | GOOD |

TABLE 7

| | | EXAMPLE | | | | | |
|---|---|---|---|---|---|---|---|
| | | 13 | 14 | 15 | 16 | 17 | 18 |
| SURFACE LAYER | COMPOSITION No. | 13 | 14 | 15 | 16 | 11 | C |
| | THICKNESS (μm) | 50 | 50 | 50 | 50 | 4000 | 6 |
| INTERMEDIATE LAYER | COMPOSITION No. | NONE | NONE | NONE | NONE | NONE | 11 |
| | THICKNESS (μm) | | | | | | 100 |
| THICKNESS OF BASE LAYER (mm) | | 4 | 4 | 4 | 4 | NONE | 4 |
| ELECTRICAL RESISTANCE | 1 V | $2.1 \times 10^6$ | $8.1 \times 10^4$ | $9.9 \times 10^4$ | $2.8 \times 10^5$ | $7.4 \times 10^7$ | $1.9 \times 10^6$ |
| (Ω) | 133 V | $1.2 \times 10^6$ | $1.6 \times 10^4$ | $1.6 \times 10^4$ | $1.4 \times 10^4$ | $4.2 \times 10^7$ | $1 \times 10^6$ |
| VOLTAGE DEPENDENCY (DIGIT) | | 0.25 | 0.70 | 0.79 | 1.29 | 0.25 | 0.26 |
| ENVIRONMENT DEPENDENCY | | 0.54 | 0.1 | 0.1 | 0.1 | 0.2 | 0.3 |
| HARDNESS (JIS A) | | 23 | 23 | 25 | 26 | 71 | 26 |
| COMPRESSION PERMANENT DISTORTION (%) | | 6 | 6 | 6 | 6 | 14 | 6 |
| CHARACTERISTICS OF | UNEVEN IMAGE | GOOD | GOOD | GOOD | GOOD | GOOD | GOOD |
| DEVELOPING ROLL | ENVIRONMENTAL CHANGE | GOOD | GOOD | GOOD | GOOD | GOOD | GOOD |

TABLE 8

| | | COMPARATIVE EXAMPLE | | | | |
|---|---|---|---|---|---|---|
| | | 1 | 2 | 3 | 4 | 5 |
| SURFACE LAYER | COMPOSITION No. | A | B | B | A | E |
| | THICKNESS (μm) | 50 | 50 | 7 | 7 | 100 |
| INTERMEDIATE LAYER | COMPOSITION No. | NONE | NONE | A | C | NONE |
| | THICKNESS (μm) | | | 50 | 50 | |
| THICKNESS OF BASE LAYER (mm) | | 4 | 4 | 4 | 4 | 4 |
| ELECTRICAL RESISTANCE | 1 V | $3.9 \times 10^5$ | $3 \times 10^8$ | $3.4 \times 10^{10}$ | $9.2 \times 10^4$ | $4.2 \times 10^9$ |
| (Ω) | 133 V | $2.3 \times 10^5$ | $1.8 \times 10^6$ | $4.7 \times 10^0$ | $3.5 \times 10^4$ | $5.9 \times 10^6$ |
| VOLTAGE DEPENDENCY (DIGIT) | | 0.22 | 2.2 | 1.85 | 0.42 | 1.85 |
| ENVIRONMENT DEPENDENCY | | 2.3 | 0.3 | 1.4 | 1.3 | 0.3 |
| HARDNESS (JIS A) | | 24 | 24 | 26 | 26 | 26 |
| COMPRESSION PERMANENT DISTORTION (%) | | 5 | 6 | 6 | 6 | 6 |
| CHARACTERISTICS OF | UNEVEN IMAGE | GOOD | POOR | POOR | GOOD | POOR |
| DEVELOPING ROLL | ENVIRONMENTAL CHANGE | POOR | GOOD | POOR | POOR | GOOD |

Preparation of Charging Roll

EXAMPLE 19

Silicone (KE1350AB made by Shin-Etsu Chemical Co.) containing dispersed carbon was injected into an injection molding die in which a core metal (SUS304 with a diameter of 10 mm) as a shaft had been fitted, and the molded silicone rubber was released after heating at 150° C. for 45 minutes to form a base layer along the outer circumference face of the shaft. The surface of the base layer was treated by corona discharge (0.3 kW, 20 seconds). Then, an intermediate layer was formed by coating the composition 11 prepared above on the outer circumference face of the base layer. In addition, a surface layer comprising the composition 2 prepared above was formed on the surface of the intermediate layer, thereby manufacturing a charging roll comprising the base layer on the outer circumference of the shaft, the intermediate layer on the outer circumference face of the base layer, and the surface layer on the outer circumference face of the intermediate layer.

EXAMPLES 20 TO 29, COMPARATIVE EXAMPLES 6 AND 7

Charging rolls were prepared by the same method as in Example 19, except that the compositions shown in Tables 9 to 11 were used as the materials for the intermediate layer and surface layer. The composition prepared by the same method as preparing the composition 17 was used for the material of the base layer in Example 24. The samples having no intermediate layer were denoted by "None" in corresponding cells of the table.

Various characteristics were assessed in accordance with the following criteria using the charging rolls in Examples and Comparative Examples obtained as described above. These results are shown in Tables 9 to 11 below. The electrical resistance, voltage dependency, environment dependency, hardness and compression set were assessed in accordance with criteria of the developing roll.

Characteristics of Charging Roll (Uneven Image)

The charging roll obtained was assembled into a commercially available color printer, and images were printed under an environment of 20° C. and 50% RH. An image having no irregular density ascribed to the roll at half-tone printing as well as no broken lines and irregular color tones was assessed to be "good", and an image manifesting irregular density was assessed to be "poor".

(Environmental Variation)

The charging roll obtained was assembled into a commercially available color printer, and images were printed under the environments of 15° C. and 10% RH, and 35° C. and 85% RH. The printed images obtained under both environments were assessed as environmental variations of the image. Solid images were measured with a Macbeth densitometer, and the image with a variation of optical density of 0.1 or less was assessed to be "good", while the image with a variation of the optical density of exceeding 0.1 was assessed as "poor".

TABLE 9

| | | EXAMPLE | | | | | |
|---|---|---|---|---|---|---|---|
| | | 19 | 20 | 21 | 22 | 23 | 24 |
| SURFACE LAYER | COMPOSITION No. | 2 | 7 | 8 | 9 | 10 | 10 |
| | THICKNESS (μm) | 5 | 100 | 100 | 100 | 5 | 5 |
| INTERMEDIATE LAYER | COMPOSITION No. | 11 | NONE | NONE | NONE | C | 11 |
| | THICKNESS (μm) | 100 | | | | 100 | 100 |
| THICKNESS OF BASE LAYER (mm) | | 3 | 3 | 3 | 3 | 3 | 3 |
| ELECTRICAL RESISTANCE | 1 V | $3.3 \times 10^6$ | $1.5 \times 10^5$ | $2.4 \times 10^5$ | $1.3 \times 10^6$ | $8.7 \times 10^4$ | $8.2 \times 10^7$ |
| (Ω) | 133 V | $1.9 \times 10^6$ | $6 \times 10^4$ | $1.3 \times 10^5$ | $3.1 \times 10^5$ | $4.9 \times 10^3$ | $5.1 \times 10^7$ |
| VOLTAGE DEPENDENCY (DIGIT) | | 0.25 | 0.38 | 0.28 | 0.63 | 1.25 | 0.21 |
| ENVIRONMENT DEPENDENCY | | 0.3 | 0.2 | 0.1 | 0.1 | 0.2 | 0.2 |
| HARDNESS (JIS A) | | 33 | 30 | 26 | 26 | 27 | 8 |
| COMPRESSION PERMANENT DISTORTION (%) | | 7 | 7 | 6 | 6 | 6 | 9 |
| CHARACTERISTICS OF | UNEVEN IMAGE | GOOD | GOOD | GOOD | GOOD | GOOD | GOOD |
| DEVELOPING ROLL | ENVIRONMENTAL CHANGE | GOOD | GOOD | GOOD | GOOD | GOOD | GOOD |

TABLE 10

| | | EXAMPLE | | | | |
|---|---|---|---|---|---|---|
| | | 25 | 26 | 27 | 28 | 29 |
| SURFACE LAYER | COMPOSITION No. | 11 | 14 | 15 | 16 | C |
| | THICKNESS (μm) | 50 | 100 | 100 | 100 | 6 |
| INTERMEDIATE LAYER | COMPOSITION No. | C | NONE | NONE | NONE | 11 |
| | THICKNESS (μm) | 50 | | | | 100 |
| THICKNESS OF BASE LAYER (mm) | | 3 | 3 | 3 | 3 | 3 |
| ELECTRICAL RESISTANCE | 1 V | $1.7 \times 10^6$ | $2.1 \times 10^5$ | $2.7 \times 10^5$ | $8.4 \times 10^5$ | $1.5 \times 10^5$ |
| (Ω) | 133 V | $9.1 \times 10^5$ | $5 \times 10^5$ | $5 \times 10^6$ | $4.3 \times 10^4$ | $1.1 \times 10^4$ |
| VOLTAGE DEPENDENCY (DIGIT) | | 0.26 | 0.62 | 0.73 | 1.32 | 1.13 |
| ENVIRONMENT DEPENDENCY | | 0.2 | 0.1 | 0.1 | 0.1 | 0.2 |
| HARDNESS (JIS A) | | 25 | 25 | 27 | 28 | 25 |
| COMPRESSION PERMANENT DISTORTION (%) | | 5 | 6 | 6 | 6 | 5 |
| CHARACTERISTICS OF | UNEVEN IMAGE | GOOD | GOOD | GOOD | GOOD | GOOD |
| DEVELOPING ROLL | ENVIRONMENTAL CHANGE | GOOD | GOOD | GOOD | GOOD | GOOD |

TABLE 11

| | | COMPARATIVE EXAMPLE | |
|---|---|---|---|
| | | 6 | 7 |
| SURFACE LAYER | COMPOSITION No. | B | B |
| | THICKNESS (μm) | 100 | 7 |
| INTERMEDIATE LAYER | COMPOSITION No. | NONE | A |
| | THICKNESS (μm) | | 50 |
| THICKNESS OF BASE LAYER (mm) | | 3 | 3 |
| ELECTRICAL RESISTANCE | 1 V | $1.1 \times 10^9$ | $4.4 \times 10^{10}$ |
| (Ω) | 133 V | $6.3 \times 10^6$ | $6.2 \times 10^8$ |
| VOLTAGE DEPENDENCY (DIGIT) | | 2.22 | 1.85 |
| ENVIRONMENT DEPENDENCY | | 0.3 | 1.4 |
| HARDNESS (JIS A) | | 26 | 28 |
| COMPRESSION PERMANENT DISTORTION (%) | | 6 | 6 |
| CHARACTERISTICS OF | UNEVEN IMAGE | POOR | POOR |
| DEVELOPING ROLL | ENVIRONMENTAL CHANGE | GOOD | POOR |

Preparation of Transfer Roll

EXAMPLE 30

Silicone rubber (KE1350AB made by Shin-Etsu Chemical Co.) containing dispersed carbon was injected into an injection molding die in which a core metal (SUS304 with a diameter of 10 mm) as a shaft had been fitted, and the molded silicone rubber was released after heating at 150° C. for 45 minutes to form a base layer along the outer circumference face of the shaft. The surface of the base layer was treated by corona discharge (0.3 kW, 20 seconds). Then, an intermediate layer was formed by coating the composition 11 prepared above on the outer circumference face of the base layer. In addition, a surface layer comprising the composition 2 prepared above was formed on the surface of the intermediate layer, thereby manufacturing a transfer roll comprising the base layer on the outer circumference of the shaft, the intermediate layer on the outer circumference face of the base layer, and the surface layer on the outer circumference face of the intermediate layer.

EXAMPLES 31 TO 37, COMPARATIVE EXAMPLES 8 AND 9

Transfer rolls were prepared by the same method as in Example 30, except that the compositions shown in Tables 12 and 13 were used as the materials for the intermediate layer and surface layer. The composition prepared by the same method as preparing the composition 17 was used for the material of the base layer in Example 37. The samples having no intermediate layer were denoted by "None" in corresponding cells of the table.

Various characteristics were assessed in accordance with the following criteria using the transfer rolls in Examples and Comparative Examples obtained as described above. These results are shown in Tables 12 and 13 below. The electrical resistance, voltage dependency, environment dependency, hardness and compression set were assessed in accordance with criteria of the developing roll.

Characteristics of Transfer Roll (Uneven Image)

The transfer roll obtained was assembled into a commercially available color printer, and images were printed under an environment of 20° C. and 50% RH. An image having no irregular density ascribed to the roll at half-tone printing as well as no broken lines and irregular color tones was assessed to be "good", and an image manifesting irregular density was assessed to be "poor".

(Environmental Variation)

The transfer roll obtained was assembled into a commercially available color printer, and images were printed under the environments of 15° C. and 10% RH, and 35° C. and 85% RH. The printed images obtained under both environments were assessed as environmental variations of the image. Solid images were measured with a Macbeth densitometer and the image with a variation of optical density of 0.1 or less was assessed to be "good", while the image with a variation of the optical density of exceeding 0.1 was assessed as "poor".

TABLE 12

| | | EXAMPLE | | | | | |
|---|---|---|---|---|---|---|---|
| | | 30 | 31 | 32 | 33 | 34 | 35 |
| SURFACE LAYER | COMPOSITION No. | 2 | 8 | 10 | C | 14 | 15 |
| | THICKNESS (μm) | 5 | 100 | 5 | 6 | 100 | 100 |
| INTERMEDIATE LAYER | COMPOSITION No. | 11 | NONE | C | 11 | NONE | NONE |
| | THICKNESS (μm) | 100 | | 100 | 100 | | |
| THICKNESS OF BASE LAYER (mm) | | 6 | 6 | 6 | 6 | 6 | 6 |
| ELECTRICAL RESISTANCE | 1 V | $1.5 \times 10^6$ | $1.3 \times 10^5$ | $5.8 \times 10^4$ | $8.6 \times 10^4$ | $1.1 \times 10^5$ | $1.4 \times 10^5$ |
| (Ω) | 133 V | $8 \times 10^5$ | $5.6 \times 10^4$ | $3.8 \times 10^3$ | $6.6 \times 10^3$ | $2.3 \times 10^4$ | $2.3 \times 10^4$ |
| VOLTAGE DEPENDENCY (DIGIT) | | 0.26 | 0.35 | 1.18 | 1.12 | 0.67 | 0.78 |
| ENVIRONMENT DEPENDENCY | | 0.3 | 0.1 | 0.2 | 0.2 | 0.1 | 0.1 |
| HARDNESS (JIS A) | | 30 | 23 | 24 | 22 | 22 | 24 |
| COMPRESSION PERMANENT DISTORTION (%) | | 6 | 5 | 5 | 5 | 5 | 6 |
| CHARACTERISTICS OF DEVELOPING ROLL | UNEVEN IMAGE | GOOD | GOOD | GOOD | GOOD | GOOD | GOOD |
| | ENVIRONMENTAL CHANGE | GOOD | GOOD | GOOD | GOOD | GOOD | GOOD |

TABLE 13

| | | EXAMPLE | | COMPARATIVE EXAMPLE | |
|---|---|---|---|---|---|
| | | 36 | 37 | 8 | 9 |
| SURFACE LAYER | COMPOSITION No. | 16 | 10 | B | B |
| | THICKNESS (μm) | 100 | 5 | 100 | 7 |
| INTERMEDIATE LAYER | COMPOSITION No. | NONE | 11 | NONE | A |
| | THICKNESS (μm) | | 100 | | 50 |
| THICKNESS OF BASE LAYER (mm) | | 6 | 6 | 6 | 6 |
| ELECTRICAL RESISTANCE | 1 V | $4 \times 10^5$ | $7 \times 10^7$ | $4.5 \times 10^8$ | $3.8 \times 10^{10}$ |
| (Ω) | 133 V | $2 \times 10^4$ | $4 \times 10^7$ | $2.7 \times 10^6$ | $5.3 \times 10^8$ |
| VOLTAGE DEPENDENCY (DIGIT) | | 1.30 | 0.21 | 2.22 | 1.9 |
| ENVIRONMENT DEPENDENCY | | 0.1 | 0.2 | 0.3 | 1.4 |
| HARDNESS (JIS A) | | 25 | 7 | 23 | 25 |
| COMPRESSION PERMANENT DISTORTION (%) | | 5 | 9 | 6 | 6 |
| CHARACTERISTICS OF DEVELOPING ROLL | UNEVEN IMAGE | GOOD | GOOD | POOR | POOR |
| | ENVIRONMENTAL CHANGE | GOOD | GOOD | GOOD | POOR |

Preparation of Transfer Belt

EXAMPLES 38 TO 45, COMPARATIVE EXAMPLES 10 AND 11

Monolayer or multilayer intermediate transfer belts (endless belt) were prepared using the compositions shown in Tables 14 and 15 as materials for the base layer, intermediate layer and surface layer. The samples having no bate layer or intermediate layer were denoted as "none" in the corresponding cells of the table.

Various characteristics were assessed in accordance with following criteria using the transfer belts in Examples and Comparative Examples obtained as described above. These results are shown in Tables 14 and 15 below.

Electrical Resistance

A SUS rod with a diameter of 10 mm and an weight of 1 kg was mounted within the transfer belt while a SUS plate was mounted outside thereof, and the electrical resistance between the SUS rod and the SUS plate was measured in accordance with SRIS 2304. Each electrical resistance at an applied voltage of 1V and 133V was measured under an environment of 25° C. and 50% RH.

Voltage Dependency

The electrical resistance at the applied voltage of 1V and the electrical resistance at the applied voltage of 133V were measured under the environment of 25° C. and 50% RH in accordance with the assessment method of the electrical resistance described above, and the difference of the electrical resistance between the two measurements was indicated by digits of variation from Log(resistance at 1V/resistance at 133V).

Environment Dependency

The electrical resistance under a low temperature—low humidity environment (15° C. and 10% RH), and the electrical resistance under a high temperature—high humidity (35° C. and 85% RH) environment were measured in accordance with the assessment method of the electrical resistance described above, and the difference of the electrical resistance between the two measurements was indicated by digits of variation. A voltage of 10V was applied in this measurement.

Characteristics of Transfer Belt (Uneven Image)

The transfer belt obtained was assembled into a commercially available color printer, and images were printed under an environment of 20° C. and 50% RH. An image having no irregular density ascribed to the roll at half-tone printing as well as no broken lines and irregular color tones was assessed to be "good", and an image manifesting irregular density was assessed to be "poor".

(Environmental Variation)

The transfer belt obtained was assembled into a commercially available color printer, and images were printed under the environments of 15° C. and 10% RH, and 35° C. and 15% RH. The printed images obtained under both environments were assessed as environmental variations of the image. Solid images were measured with a Macbeth densitometer, and the image with a variation of optical density of 0.1 or less was assessed to be "good", while the image with a variation of the optical density of exceeding 0.1 was assessed as "poor".

TABLE 14

| | | EXAMPLE | | | | | |
|---|---|---|---|---|---|---|---|
| | | 38 | 39 | 40 | 41 | 42 | 43 |
| SURFACE LAYER | COMPOSITION No. | 2 | 5 | 5 | 8 | 8 | 10 |
| | THICKNESS (μm) | 3 | 3 | 3 | 50 | 250 | 5 |
| INTERMEDIATE LAYER | COMPOSITION No. | NONE | 11 | A | 7 | NONE | 11 |
| | THICKNESS (μm) | | 50 | 2 | 5 | | 50 |
| BASE LAYER | COMPOSITION No. | C | C | C | C | NONE | 8 |
| | THICKNESS (μm) | 250 | 200 | 250 | 200 | | 200 |
| ELECTRICAL | 1 V | $7.5 \times 10^5$ | $6.2 \times 10^9$ | $6.2 \times 10^9$ | $1.1 \times 10^6$ | $3.5 \times 10^6$ | $1.4 \times 10^7$ |
| RESISTANCE (Ω) | 133 V | $1.6 \times 10^5$ | $5 \times 10^3$ | $4.9 \times 10^9$ | $4.6 \times 10^5$ | $2.2 \times 10^6$ | $8.3 \times 10^6$ |
| VOLTAGE DEPENDENCY (DIGIT) | | 0.68 | 0.1 | 0.1 | 0.37 | 0.2 | 0.24 |
| ENVIRONMENT DEPENDENCY | | 0.3 | 0.1 | 0.8 | 0.1 | 0.3 | 0.2 |
| CHARACTERISTICS OF DEVELOPING ROLL | UNEVEN IMAGE | GOOD | GOOD | GOOD | GOOD | GOOD | GOOD |
| | ENVIRONMENTAL CHANGE | GOOD | GOOD | GOOD | GOOD | GOOD | GOOD |

TABLE 15

| | | EXAMPLE | | COMPARATIVE EXAMPLE | |
|---|---|---|---|---|---|
| | | 44 | 45 | 10 | 11 |
| SURFACE LAYER | COMPOSITION No. | 14 | 15 | B | E |
| | THICKNESS (μm) | 100 | 100 | 50 | 50 |
| INTERMEDIATE LAYER | COMPOSITION No. | NONE | NONE | A | NONE |
| | THICKNESS (μm) | | | 50 | |
| BASE LAYER | COMPOSITION No. | C | C | C | C |
| | THICKNESS (μm) | 150 | 150 | 200 | 200 |
| ELECTRICAL | 1 V | $1.4 \times 10^6$ | $1.8 \times 10^6$ | $2.5 \times 10^{10}$ | $5.6 \times 10^9$ |
| RESISTANCE (Ω) | 133 V | $3.3 \times 10^5$ | $3.3 \times 10^5$ | $3.2 \times 10^8$ | $7.5 \times 10^7$ |

TABLE 15-continued

| | | EXAMPLE | | COMPARATIVE EXAMPLE | |
|---|---|---|---|---|---|
| | | 44 | 45 | 10 | 11 |
| VOLTAGE DEPENDENCY (DIGIT) | | 0.63 | 0.75 | 1.89 | 1.87 |
| ENVIRONMENT DEPENDENCY | | 0.1 | 0.1 | 1.4 | 0.3 |
| CHARACTERISTICS OF DEVELOPING ROLL | UNEVEN IMAGE | GOOD | GOOD | POOR | POOR |
| | ENVIRONMENTAL CHANGE | GOOD | GOOD | POOR | GOOD |

Preparation of Toner Supply Roll

EXAMPLE 46

A toner roll with a monolayer structure was prepared by forming a sponge layer along the circumference face of a shaft using the composition 1.7 Blended were 90 parts of polyether polyol (FA718 made by Sanyo Chemical Co.), 10 parts of polymer polyol (POP31-28 made by Mitsui Chemical Co.), 0.5 parts of a tertiary amine catalyst (Kaolizer No, 31 made by Kao Co.), 0.05 parts of a tertiary amine catalyst (Toyocat HX-35 made by Tosoh Co.), 2 parts of foaming agent (aqueous solution), silicone based foam controlling agent (L-5309 made by Nihon Unicar Co.), and 20 parts of polyaniline (without drying) having a surfactant structure prepared by the same method as used for preparing the composition 1. The mixture was kneaded using a triple-axis roll. Subsequently, 8.8 parts of crude MDI (Sumidur 44V20 made by Sumitomo Bayer Urethane Co.) and 20.5 parts of toluene diisocyanate (TDI-80) made by Mitsui Chemical Co.) were added to the mixture with stirring in an injection molding machine, and the molded mixture was injected into a die for molding the toner supply roll fitted with a core metal (a diameter of 5 mm made of SUS304) as a shaft. The molded mixture was foamed by heating at 80° C. for 30 minutes. The mold was released thereafter and the surface thereof was ground to prepare the toner supply roll comprising a sponge layer formed along the outer circumference face of the shaft.

These results are shows in Table 16 below. The electrical resistance, voltage dependency, environment dependency, hardness and compression set were assessed in accordance with the assessment of the developing roll.

Characteristics of Toner Supply Roll (Uneven Image)

The toner supply roll obtained was assembled into a commercially available color printer, and images were printed under an environment of 20° C. and 50% RH. An image having no irregular density ascribed to the toner supply roll at half-tone printing as well as no broken lines and no scattering of the toner was assessed to be "good", and an image printed on a white background was measured with a Macbeth densitometer, and the image having a variation of optical density of 0.1 or more was assessed to be "poor".

(Environmental Variation)

The toner supply roll obtained was assembled into a commercially available color printer, and images were printed under the environments of 15° C. and 10% RH, and 35° C. and 85% RH. The printed images obtained under both environments were assessed as environmental variations of the image. Solid images were measured with a Macbeth densitometer, and the image with a variation of optical density of 0.1 or less was assessed to be "good", while the image with a variation of the optical density of exceeding 0.1 was assessed as "poor".

TABLE 16

| | | EXAMPLE 46 | COMPARATIVE EXAMPLE 12 |
|---|---|---|---|
| SPONGE LAYER | COMPOSITION No. | 17 | F |
| | THICKNESS (μm) | 3 | 3 |
| ELECTRICAL RESISTANCE | 133 V | $2.8 \times 10^7$ | $1 \times 10^{10}$ |
| (Ω) | 1.30 | $1.7 \times 10^7$ | $2 \times 10^7$ |
| VOLTAGE DEPENDENCY (DIGIT) | | 0.22 | 2.15 |
| ENVIRONMENT DEPENDENCY | | 0.3 | 0.3 |
| HARDNESS (JIS A) | | 2 | 2 |
| COMPRESSION PERMANENT DISTORTION (%) | | 7 | 7 |
| CHARACTERISTICS OF TONER SUPPLY ROLL | UNEVEN IMAGE | GOOD | POOR |
| | ENVIRONMENTAL CHANGE | GOOD | GOOD |

COMPARATIVE EXAMPLE 12

A toner supply roll was prepared by the same method as in Example 46, except that the composition F was used in place of the composition 17.

Various characteristics were assessed in accordance with following criteria using the toner supply roll in Examples and Comparative Examples obtained as described above.

The results as hitherto described show that the samples in Examples are excellent in the characteristics of the developing roll, charging roll, transfer roll, transfer belt and toner supply roll. The reason is supposed as follows. Since the material for the surface layer (the material constituting the layer when the surface layer has a monolayer structure) comprises the conductive polymer and the binder polymer, advantages of the ion-conductive agent that is excellent in the voltage dependency of the electrical resistance and advantages of the electron-conductive agent that is excellent in the environment dependency of the electrical resistance are simultaneously provided in the surface layer, because a polymer alloy comprising a complex of the selected conductive polymer and binder polymer is formed in the surface layer as a result of fine dispersion or dissolution of the conductive polymer in the binder polymer.

In contrast, since the samples in Comparative Examples 1 to 11 is poor in at least one of the voltage dependency and environment dependency of the electrical resistance, they are inferior in the characteristics of the developing roll, charging roll, transfer roll and transfer belt. The sample in Comparative Example 12 is inferior in the characteristics of the toner supply roll, because it shows a large voltage dependency of the electrical resistance.

Accordingly, the elastic member of the semiconductive polymer according to the present invention is excellent in both characteristics of voltage dependency and environment dependency with a voltage dependency of the electrical resistance of 1.5 digits or less and an environment dependency of the electrical resistance of 1 digit or less in the range of an applied voltage of 1V to 133V. As a result, the electrical resistance against an applied voltage may be controlled within a prescribed range, enabling the toner forming ability and charging ability of the developing roll to be stabilized and electric current in a photosensitive material of the charging member to be stabilized. Since the toner on the photosensitive member is transferred by controlling the voltage, transfer performance of the transfer member may be stabilized. Therefore, the elastic member according to the present invention is effective for sensor materials and current control elements such as an actuator that takes advantage of such differences of the electrical characteristics.

Electrical characteristics suitable for OA equipment may arise when the elastic member of the semiconductive polymer according to the present invention has an electrical resistance in the range of $10^6$ to $10^{12}$ Ω·cm.

Electrical characteristics is stabilized against the change of the shape when the increment of the electrical resistance of the elastic member of the semiconductive polymer according to the present invention at 100% elongation is 1.3 digits or less relative to the electrical resistance with no elongation. Consequently, variation of the electrical characteristics when the polymer is used as large deformation, and deterioration of the electrical characteristics in a long period of use are suppressed to enable the image quality to be maintained in a high level. Therefore, the elastic member according to the present invention is suitable for use in soft members for high speed printing with intact handling of delicate toners having a low melting point.

What is claimed is:

1. An OA equipment using an elastic member of a semiconductive polymer for at least a part of the constituting members of the OA equipment, the elastic member of the semiconductive polymer comprising a conductive composition containing a binder polymer soluble in an organic solvent and a conductive polymer soluble or capable of forming a colloid solution in the organic solvent or the binder solution, wherein the conductive polymer is dispersed in the binder polymer with a particle diameter of 1 μm or less, or is compatible with the binder polymer, wherein the elastic member satisfies both characteristics of:

(A) a variation of 1.5 digit or less between the electrical resistance at an applied voltage of 1V and the electrical resistance at an applied voltage of 133V under an environment of 25° C. and 50% RH; and (B) a variation of one digit or less between the electrical resistance at an applied voltage of 10V under an environment of 15° C. and 10% RH and the electrical resistance at an applied voltage of 10V under an environment of 35° C. and 85% RH.

2. The OA equipment according to claim 1, wherein the electrical resistance at an applied voltage of 10V is in the range of $10^6$ to $10^{12}$ Ω·cm under an environment of 25° C. and 50% RH.

3. The OA equipment according to claim 1, wherein the increment of the electrical resistance at an elongation of 100% relative to the electrical resistance with no elongation is 1.3 digits or less.

4. The OA equipment according to claim 1, wherein the conductive polymer has a surfactant structure.

5. The OA equipment according to claim 4 prepared by a method comprising the steps of:

synthesizing a conductive polymer having a surfactant structure using a starting monomer and a surfactant; and allowing the conductive polymer to disperse in a binder polymer using a high shear stress dispersion mill.

6. The OA equipment according to claim 4, wherein the conductive polymer having a surfactant structure is a conductive polymer having a sulfate structure.

7. The OA equipment according to claim 4, wherein the conductive polymer having a surfactant structure is a conductive polymer having a benzene sulfonic acid structure which contains an alkyl group having a carbon number of 12 to 15.

* * * * *